US006415513B1

(12) United States Patent
Eichhorn et al.

(10) Patent No.: US 6,415,513 B1
(45) Date of Patent: Jul. 9, 2002

(54) DRY SHAVING APPARATUS

(75) Inventors: Reinhold Eichhorn, Idstein; Michael Harms, Oberursel; Sebastian Hottenrott, Istein; Peter Junk, Schmitten; Michael Odemer; Jens Störkel, both of Frankfurt; Jürgen Wolf, Kriftel, all of (DE)

(73) Assignee: Braun GmbH, Kronberg/Taunus (DE)

( * ) Notice: Subject to any disclaimer, the term of this patent is extended or adjusted under 35 U.S.C. 154(b) by 0 days.

(21) Appl. No.: 09/765,258

(22) Filed: Jan. 18, 2001

Related U.S. Application Data

(63) Continuation of application No. PCT/EP99/04446, filed on Jun. 26, 1999.

(30) Foreign Application Priority Data

Jul. 20, 1998 (DE) ..... 198 32 473

(51) Int. Cl.[7] ..... B26B 19/04
(52) U.S. Cl. ..... 30/43.92; 30/346.51
(58) Field of Search ..... 30/43, 43.91, 43.92, 30/41.6, 346.51

(56) References Cited

U.S. PATENT DOCUMENTS

| | | | | |
|---|---|---|---|---|
| 3,111,754 A | | 11/1963 | Locke | 30/41 |
| 4,578,861 A | | 4/1986 | Schweingrüber et al. | 30/43.92 |
| 4,604,801 A | | 8/1986 | Ullmann et al. | 30/43.92 |
| 5,343,621 A | | 9/1994 | Hildebrand et al. | 30/43.92 |
| 5,542,179 A | | 8/1996 | Beutel | 30/43.92 |
| 5,611,145 A | * | 3/1997 | Wetzel et al. | 30/43.92 |
| 5,706,582 A | * | 1/1998 | Hosokawa et al. | 30/43.92 |
| 5,964,034 A | * | 10/1999 | Sueyoshi et al. | 30/43.92 |
| 6,205,666 B1 | * | 3/2001 | Junk | 30/43.92 |

FOREIGN PATENT DOCUMENTS

| | | | |
|---|---|---|---|
| DE | 1 183 405 | 12/1964 | |
| DE | 33 02 610 A1 | 8/1984 | B26B/19/04 |
| DE | 34 15 122 A1 | 10/1985 | B26B/19/04 |
| DE | 41 28 218 C1 | 8/1992 | B26B/19/04 |
| DE | 44 10 543 C1 | 12/1994 | B26B/19/04 |
| DE | 196 32 333 C1 | 6/1997 | B26B/19/04 |
| GB | 2 036 631 A | 7/1980 | B26B/19/04 |

OTHER PUBLICATIONS

Int'l. Search Report dated Oct. 12, 1999 in corresponding PCT/EP99/04446.

Int'l Preliminary Exam. Report dated Apr. 19, 2000 in corresponding PCT/EP99/04446.

* cited by examiner

*Primary Examiner*—Hwei-Siu Payer
(74) *Attorney, Agent, or Firm*—Edward S. Podszus

(57) ABSTRACT

The invention is directed to a dry shaving apparatus with a housing, comprising a housing part (G), at least one cutter element capable of reciprocating in a horizontal plane (E) and a removable frame (WR) having at least one cutter element (S) and detachably held on the housing part (G) by at least two detent mechanisms (R1, R2; R3, R4), said detent mechanisms (R1, R2; R3, R4) being formed by a seating surface (20, 21) provided on the removable frame (WR) and a seating surface (80, 90) of a resiliently mounted detent element (18, 19) exerting a locking force (FR), wherein the detent mechanisms (R1, R2; R3, R4) are capable of exerting a holding function and a vibration-free positioning function of the removable frame (WR) on the housing part (G).

18 Claims, 9 Drawing Sheets

P2
P
P1
33
21
100
111
110
20
(+)x
(-)x
(+)y
(-)y
(+)z
(-)z
y(-)
β
γ

DRY SHAVING APPARATUS

This is a continuation of International Application No. PCT/EP99/04446, pending, with an International filing date of Jun. 26, 1999.

FIELD OF THE INVENTION

This invention relates to a dry shaving apparatus.

BACKGROUND

A dry shaving apparatus of the type initially referred to is known from printed specification DE 33 02 610 A1. The removable frame disposed in a housing part sits by means of a flange on a housing ledge and is coupled to the housing by a positive-engagement detent device formed by projections engaging within recesses, said device acting in the two working directions of a movable cutter element.

A housing part provided for receiving and holding a removable frame may be arranged on the housing of a dry shaving apparatus either detachably—see DE 33 02 610 A1—or so as to be fixedly connected with the housing, meaning that it forms a component part of the housing—see DE 44 10 543 C1, FIG. 10.

Positive couplings between a removable frame and a housing part of a dry shaving apparatus for the purpose of ensuring a vibration-free seat of the removable frame necessitate an engagement of cooperating positive-engagement elements free from relative movements, that is, clearance-free positive engagement. While clearance-free positive engagement is obtainable at increased manufacturing expense, it is nevertheless susceptible to wear over time due to attrition taking place during use or deformation of cooperating positive-engagement elements, thereby precluding the desired effect to reliably prevent vibration of the removable frame equipped with at least one cutter element.

From DE 196 32 333 C1 a dry shaving apparatus of the type initially referred to is known in which a non wearing seat of the removable frame in a housing part is reliably ensured, however in this known dry shaving apparatus provision is made for additional devices, such as movably mounted pressure elements in the housing which are acted upon by spring elements and urge the removable frame against a stop provided on the housing part.

SUMMARY OF THE INVENTION

It is an object of the present invention to simplify and render less expensive the releasable fastening of a removable frame to the housing part of a dry shaving apparatus of the type initially referred to, while ensuring a vibration-free fastening of the removable frame to the housing part.

According to the present invention, this object is accomplished in a dry shaving apparatus.

It is an essential advantage of the present invention that the existing detent devices releasably holding the removable frame on the housing part are utilized for a reliable, vibration-free seat of the removable frame on the housing part, thereby eliminating the need for additional, cost-producing components.

In a preferred embodiment of the invention the locking force of the detent element is convertible into a position-force component and a holding-force component by spatially aligning the seating surfaces of the detent element and the seating surfaces of the removable frame. In a further aspect of this embodiment, the vibration-free positioning of the removable frame is determined by engagement of the removable frame with a stop on the housing part under the action of the position-force component upon the seating surface of the removable frame. The significant advantage of these arrangements resides in that, proceeding from the known state of the art—see DE 196 32 333 C1—it is only necessary for the existing seating surfaces on the detent elements and for the seating surfaces provided in the removable frame to be given a different shape, such that the spatial alignment of all seating surfaces effects a conversion of the locking force of the detent element into a holding-force component and a position-force component pointing in a common direction. This is purely a matter of shape design accomplishable simply by modifying the injection molds for the detent elements and the removable frame.

In a preferred embodiment of the invention, the stop is formed by an inner surface of the housing part. This embodiment, for example, incurs no cost because an existing wall of the housing part is made use of as seat or support of the removable frame for vibration-free seating. Any wear occurring on the seating surfaces of the detent elements and the seating surfaces in the removable frame and also on the cooperating surfaces of the removable frame and the stop are compensated for automatically through the locking force of the detent elements.

In a further aspect of the invention the stop is provided on an inner surface of the housing part. In a further aspect of the invention the inner surface is a component part of an end wall of the housing part. An essential advantage of these embodiments is that they equally make use of existing components, such as the end wall of the housing part, to perform a further new function.

A preferred embodiment of the invention is characterized in that the position-force component is effective only in one direction of the directions of oscillation of the movable cutter element. This has the advantage that by virtue of a corresponding contour of the seating surfaces on the detent elements the removable frame is seatable on and lockable with the housing part either way.

In an embodiment of the invention the holding-force component is effective in opposition to the direction of withdrawal of the removable frame from the housing part.

In a preferred embodiment of the invention two seating surfaces are provided on each longitudinal side wall of the removable frame.

A particularly advantageous embodiment of the invention is characterized in that, proceeding from a common origin the seating surfaces extend at an inclination to the x-axis, the y-axis and the z-axis. In a preferred embodiment of the invention, with reference to the stop all the seating surfaces provided on the longitudinal side walls of the removable frame are constructed to ascend in the coordinate axes x and y as well as x and z relative to a common origin. In adaptation to these embodiments, in a further aspect of the invention at least one seating surface is provided on the detent element. In a preferred embodiment of the invention, two seating surfaces are provided on the detent element. In a further aspect of this last-mentioned embodiment, the seating surfaces are constructed so as to extend in wedge shape relative to each other. A significant advantage of this embodiment resides in that it eliminates the need for the removable frame to be installed in a particular seating direction when it is placed down on the housing part and locked therewith by means of the detent elements for it to be subsequently held against the stop provided on the housing part in vibration-free manner.

In another embodiment of the invention the alignment of the seating surfaces of the detent elements is adapted essentially to the alignment of the seating surfaces on the removable frame. In a further aspect of this embodiment, the shape of the seating surface of the detent element is adapted to the seating surface of the removable frame in such manner that the engagement of cooperating seating surfaces is determined by line-type contact. An alternative embodiment of the invention is characterized in that the engagement of the seating surface of the detent element with the seating surfaces of the removable frame is determined by point-type contact.

In a still further embodiment of the invention the detent elements arranged in the housing part are adapted to be acted upon by a spring element. Preferably, a spring element is provided to act upon two detent elements acting in opposite directions.

Embodiments of the present invention will be illustrated and described in more detail in the following with reference to the accompanying drawings.

DETAILED DESCRIPTION OF PREFERRED EMBODIMENTS

Figure 1:
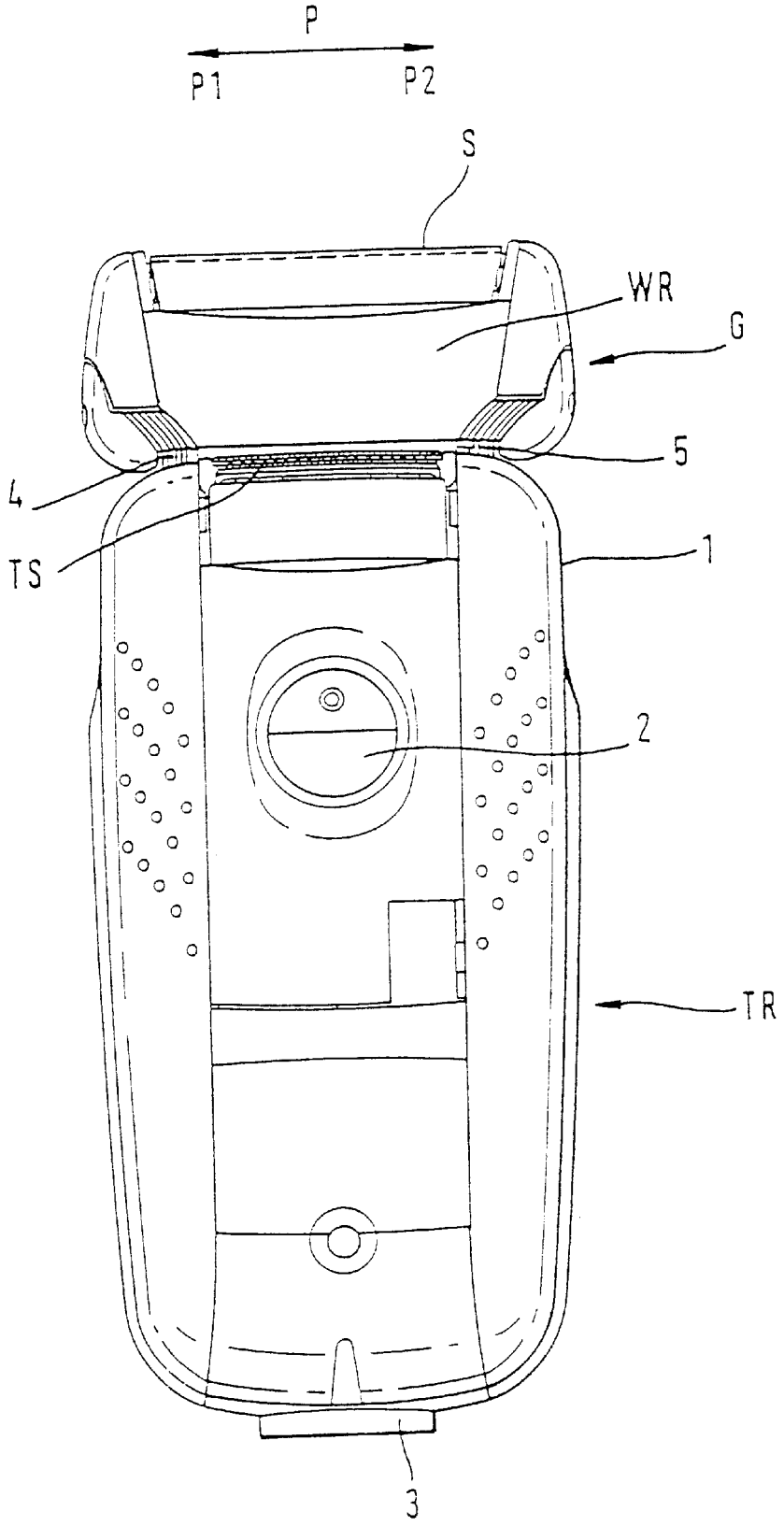
FIG. 1 is a front view of a dry shaving apparatus with a shaving head arranged on a housing and comprising a housing part and a removable frame with cutter element.

FIG. 1 shows a dry shaving apparatus TR with a housing 1 having arranged in its front panel an actuating switch 2 and an adjustably mounted trimmer unit TS. Provided in the bottom wall of the housing 1 is a socket 3 for connection to a power supply cord. Seated on the housing 1 is a shaving head having detachably secured in its housing part G a removable frame WR comprising at least one cutter element S. The housing part G of the shaving head is coupled to the housing by two supporting elements 4 and 5. Together with the housing part G the supporting elements 4 and 5 are mounted in the housing 1 for back and-forth movement in the directions P1, P2 of arrow P. In another embodiment the supporting elements 4, 5 are immovably secured in or on the housing 1.

Figure 2:
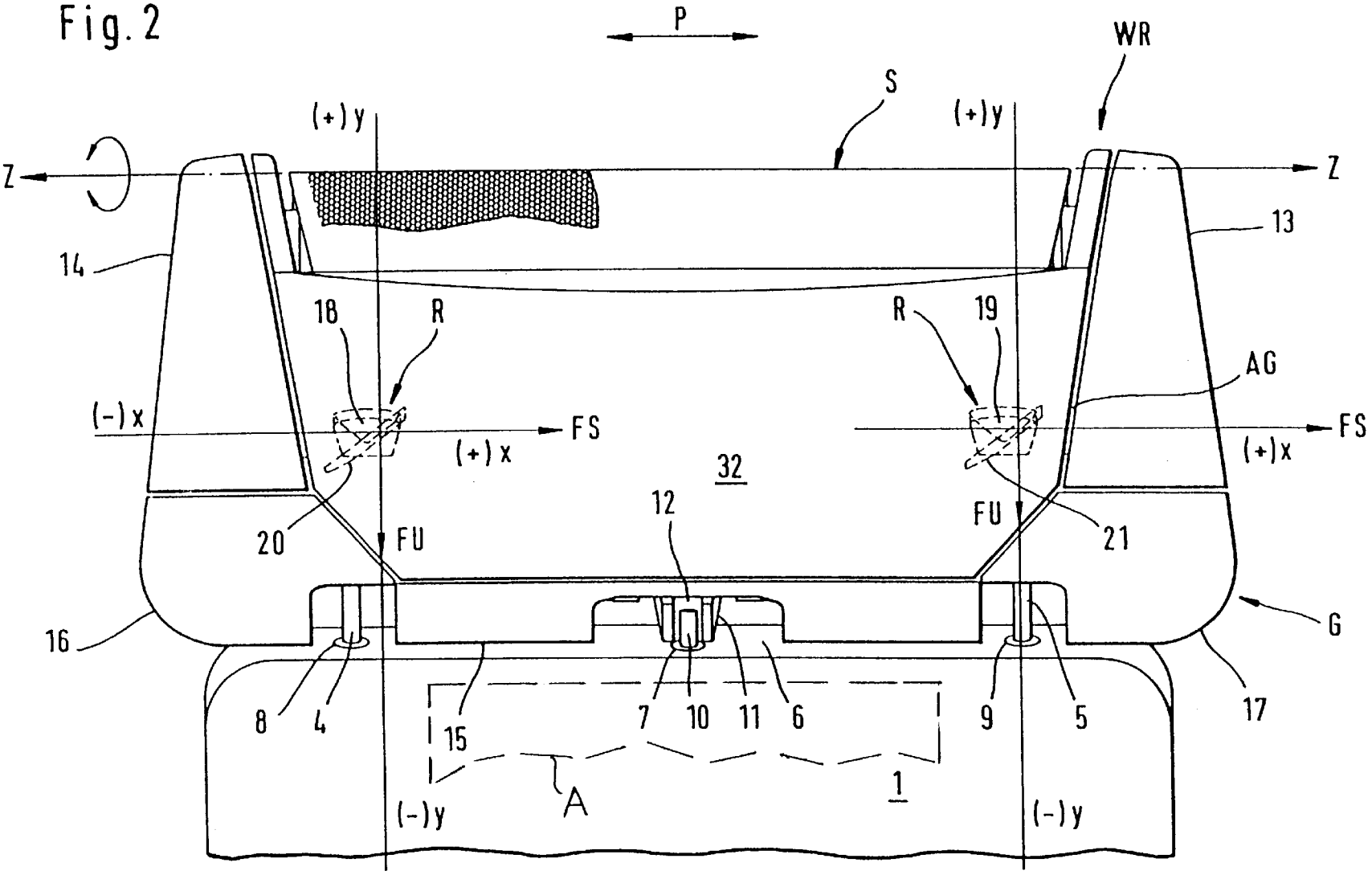
FIG. 2 is a view of the upper part of the housing of a dry shaving apparatus having arranged above it a shaving head with a removable frame shown locked with the housing part.

FIG. 2 shows the upper part of the housing 1 having in its upper side 6 several apertures 7, 8, 9 for passage of the supporting elements 4 and 5 projecting from the housing and a drive pin 10 of an electric drive mechanism A arranged in the housing 1. The drive pin 10 makes engagement with a groove 12 of a coupling element 11 for transmission of a drive motion reciprocating in the directions of arrow P to a cutter element S mounted for oscillatory motion in the housing part G via a coupling element K—see FIG. 3. The housing part G is comprised of two opposed end walls 13, 14 and a housing central portion 15 carrying the end walls. Detachably held between the two end walls 13 and 14 by means of detent mechanisms R is a removable frame WR. The removable frame WR receives at least one cutter element S and/or one cutter unit comprised of two cooperating cutter elements. The locking force exertable by the detent elements 18, 19 in a direction transverse to the directions of oscillation—directions of arrow P—of a movable cutter element S is convertible into a position-force component FS and a holding-force component FU by means of the spatial alignment of the seating surfaces 80, 90 provided on the detent elements 18, 19 and the seating surfaces 20, 21 provided on the removable frame WR—see FIG. 3 and FIG. 4—, such that the position-force component FS becoming effective in a horizontal direction (+)x causes the removable frame WR to be urged against. a stop AG provided on the housing part G, while the holding-force component FU becoming effective in a vertical direction (−) y downwardly towards the housing 1 causes the removable frame to be held on the housing part G by the detent elements 18, 19.

In the embodiment of FIG. 2 the housing part G of the shaving head is mounted on the supporting elements 4 and 5 for pivotal movement about a pivot axis Z—Z. To this effect, the supporting elements 4 and 5 protrude into the interior of the end walls 13 and 14 to ensure pivotability of the shaving head in the area of the pivot axis Z—Z by means of a pivot bearing—not shown. In another embodiment the housing part G of the shaving head may be rigidly secured to the housing 1 of the dry shaving apparatus or it may be constructed as a component part of the housing—not shown. The supporting elements 4 and 5 are either rigidly secured in the housing 1 or, in an alternative embodiment, mounted for movement at least in the directions of arrow P. Provided on the housing part G are two pushbuttons 16, 17 which, by acting on the detent mechanisms R, enable the removable frame WR to be unlocked for the purpose of detaching it.

Figure 3:
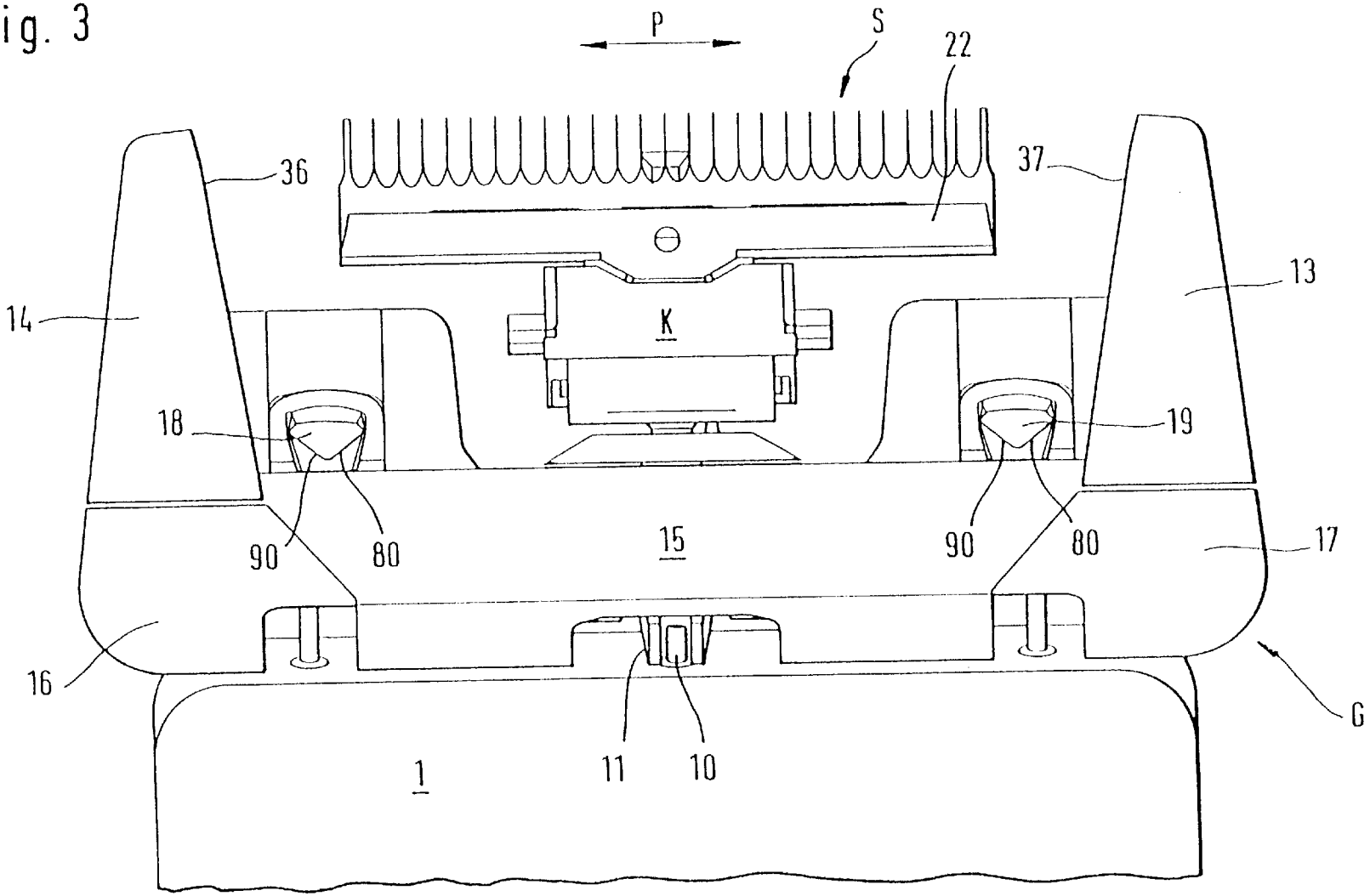
FIG. 3 is a view of the upper part of the housing of a dry shaving apparatus with a housing part arranged above it, but absent a removable frame.

FIG. 3 shows the upper part of the housing 1 with a housing part G disposed thereon but with the removable frame WR detached to reveal further components of the shaving head and their arrangement in the housing part G. Resiliently mounted adjacent to the end walls 13 and 14 in the housing central portion 15 are respective detent elements 18 and 19. A cutter element S constructed as undercutter 22 is arranged on a coupling element K between the two end walls 13 and 14 having inner surfaces 36, 37. The coupling element K with its cutter element S is movably arranged in the housing central portion 15 and coupled to the coupling element 11 for transmission of the drive motion of the drive pin 10. Provided on each of the detent elements 18 and 19 is a seating surface 80 and a seating surface 90. The seating surfaces 80 and 90 extend in wedge shape towards each other and are provided at the ends of the detent elements 18 and 19.

Figure 4:
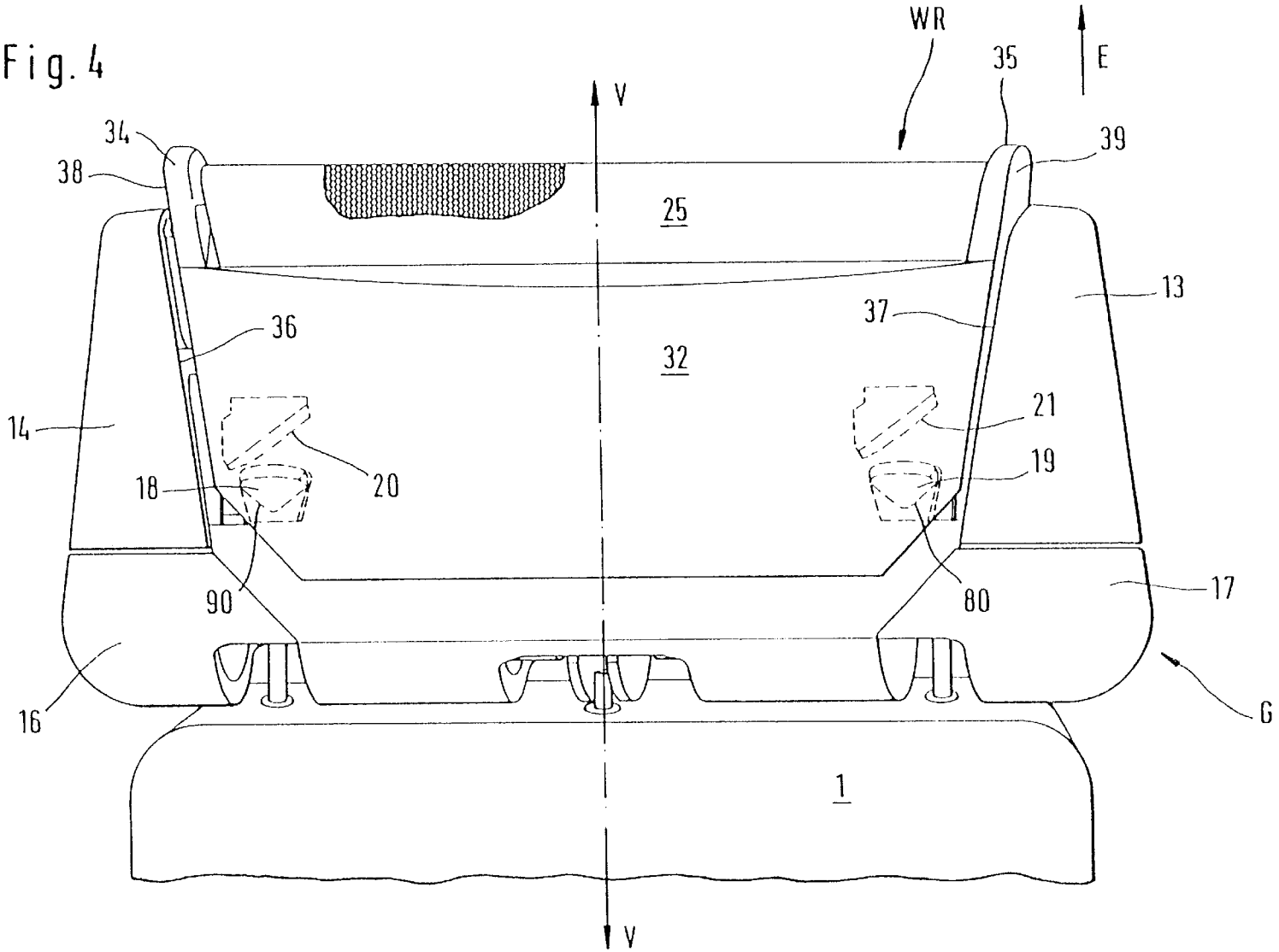
FIG. 4 is a view of the upper part of the housing with a housing part arranged above it and a removable frame shown in unlocked position and having seating surfaces formed on the inside of a longitudinal side wall.

FIG. 4 shows the upper part of the housing 1 with a housing part G arranged thereon and a removable frame WR detachable in the direction of withdrawal indicated by the direction of arrow E. The removable frame WR is essentially comprised of two bars 32 and 33 extending in the longitudinal direction—direction of arrow P—and end walls 34 and 35 connecting the bars 32 and 33—see FIG. 5—, as well as at least one outer cutter 25 seated between the bars 32, 33 and the end walls 34, 35. The inner surfaces 36 and 37 of the end walls 13 and 14 and the outer surfaces 38 and 39 of the end walls 34 and 35 extend in a wedge-shaped configuration relative to the vertical center axis V of the dry shaving apparatus TR, such that the relative distance of the end walls 13 and 14 in the area of the housing central portion 15 is smaller than the relative distance of the end walls 13 and 14 at the level of the outer cutter 25. This shape has the result that, with the removable frame WR locked with the housing part G, the end walls 34 and 35 touch or nearly touch the inner surfaces 36 and 37 of the end walls 13 and 14.

Operation of the pushbuttons 16, 17 enables unlocking of the removable frame WR. With the removable frame WR in the position shown, the detent elements 18, 19 are disengaged from the seating surfaces 20, 21 provided on the bars 32, 33 of the removable frame WR, as shown, for example, in FIG. 4 by broken lines.

Figure 5:
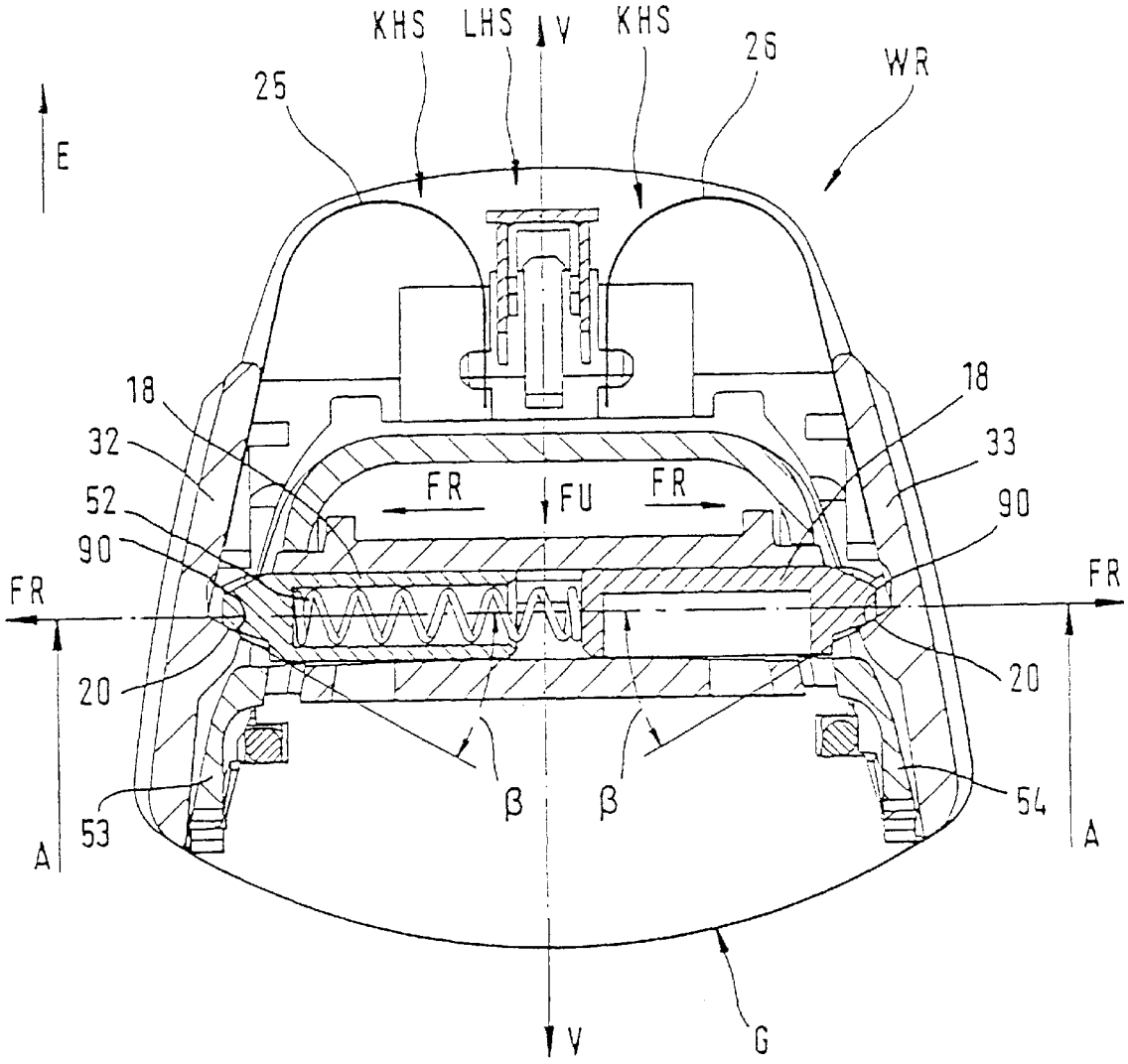
FIG. 5 is a sectional view of the housing part in the area of detent elements and of the seating surfaces provided in the removable frame.

FIG. 5 shows a sectional view of the housing part G in the area of the detent elements 18 movable in relative opposite direction in the housing part G and their associated seating surfaces 20, as well as of the removable frame WR. In the embodiment shown in this Figure, the removable frame WR receives the outer cutters 25 and 26 of a respective short hair cutter unit KHS and also a long hair cutter unit LHS. Formed in the bars 32, 33 extending in the longitudinal direction of the removable frame WR is a respective sloping seating surface 20 for engagement with a respective detent element 18. Seated between the two detent elements 18 is a spring element 52 by means of which the two detent elements 18 are held in a locked position in which they protrude from the respective longitudinal side wall 53 and 54 of the housing part G. When the removable frame WR is removed from the housing part G in the direction of withdrawal indicated by arrow E, the sloping surfaces of the seating surfaces 20, 21 exert a pressure on the seating surfaces 80, 90 of the detent elements 18, 19 which project from the housing part G, moving the detent elements 18, 19 in opposition to the pressure of the spring element 52 into the interior of the housing part G until the seating surfaces 20, 21 of the bars 32 and 33 have traveled past all detent elements 18 and 19 provided. This then releases the removable frame WR from the housing part G.

The spring. force exerted by the spring element 52 on the two detent elements 18 acts as a locking force FR via the seating surfaces 90 provided on the detent elements 18 onto the sloping seating surfaces 20 provided on the bars 32, 33 of the removable frame WR. By means of the seating surfaces 20 extending at a predetermined angle β to the horizontal direction of action of the locking force FR, the locking force FR is converted, via the seating surfaces 90 of the detent elements 18 acting thereon, into a corresponding holding-force component FU acting in opposition to the direction of arrow E—see FIG. 2—, whereby the removable frame WR is held locked with a housing part G. A similar construction and function exists also in the locking area of the detent elements 19 acted upon by a spring element and bearing upon seating surfaces 21 provided in the removable frame.

Figure 6:
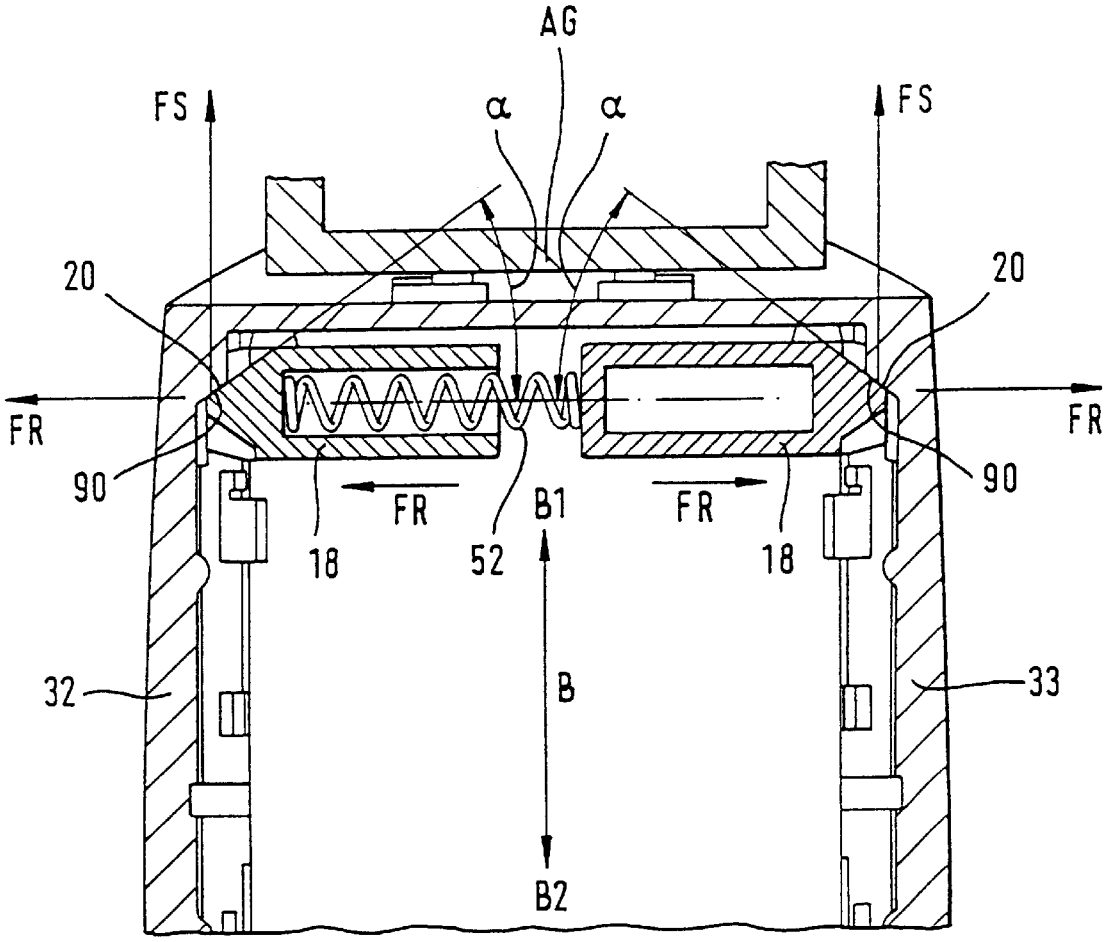
FIG. 6 is a sectional view of the longitudinal side walls and an end wall of the removable frame of FIG. 5, showing cooperating seating surfaces of the removable frame and the detent elements.

FIG. 6 shows part of a removable frame with detent elements 18 acted upon by a spring element 52, taken along the section line A—A of FIG. 5. The spring force exerted by the spring element 52 on the two detent elements 18 acts as locking force FR through the seating surfaces 90 provided on the detent elements 18 upon the sloping seating surfaces 20 provided on the bars 32, 33 of the removable frame WR. By means of the seating surfaces 20 extending at a predetermined angle α to the horizontal direction of action of the locking force FR, the locking force FR is converted into a corresponding position-force component FS via the seating surfaces 90 of the detent elements 18 acting thereon, whereby the removable frame WR is held against a stop AG on the housing part G in the direction B1 of the directions of arrows B. In the condition illustrated in FIG. 6, the outer surface 38 of the removable frame WR rests against the stop AG formed by the inner surface 36 of the end wall 14 of the housing part G.

FIGS. 7, 7*a*, 7*b* and 7*c* and 7*d* illustrate, for example, the bar 33 of a removable frame WR schematically in order to give a visual indication of the sloping course of the seating surfaces 20 and 21. Formed on the inner wall of the bar 33 at a relatively wide relative spacing—see FIG. 2—are the seating surfaces 20, 21 as component parts of projections 110 and 111, with the spatial alignment of the seating surfaces 20, 21 being explained in more detail with reference to a system of coordinates, using the projection 111 as substitute for all seating surfaces 20, 21 provided on the removable frame WR.

Figures 7, 7A, 7B, 7C:
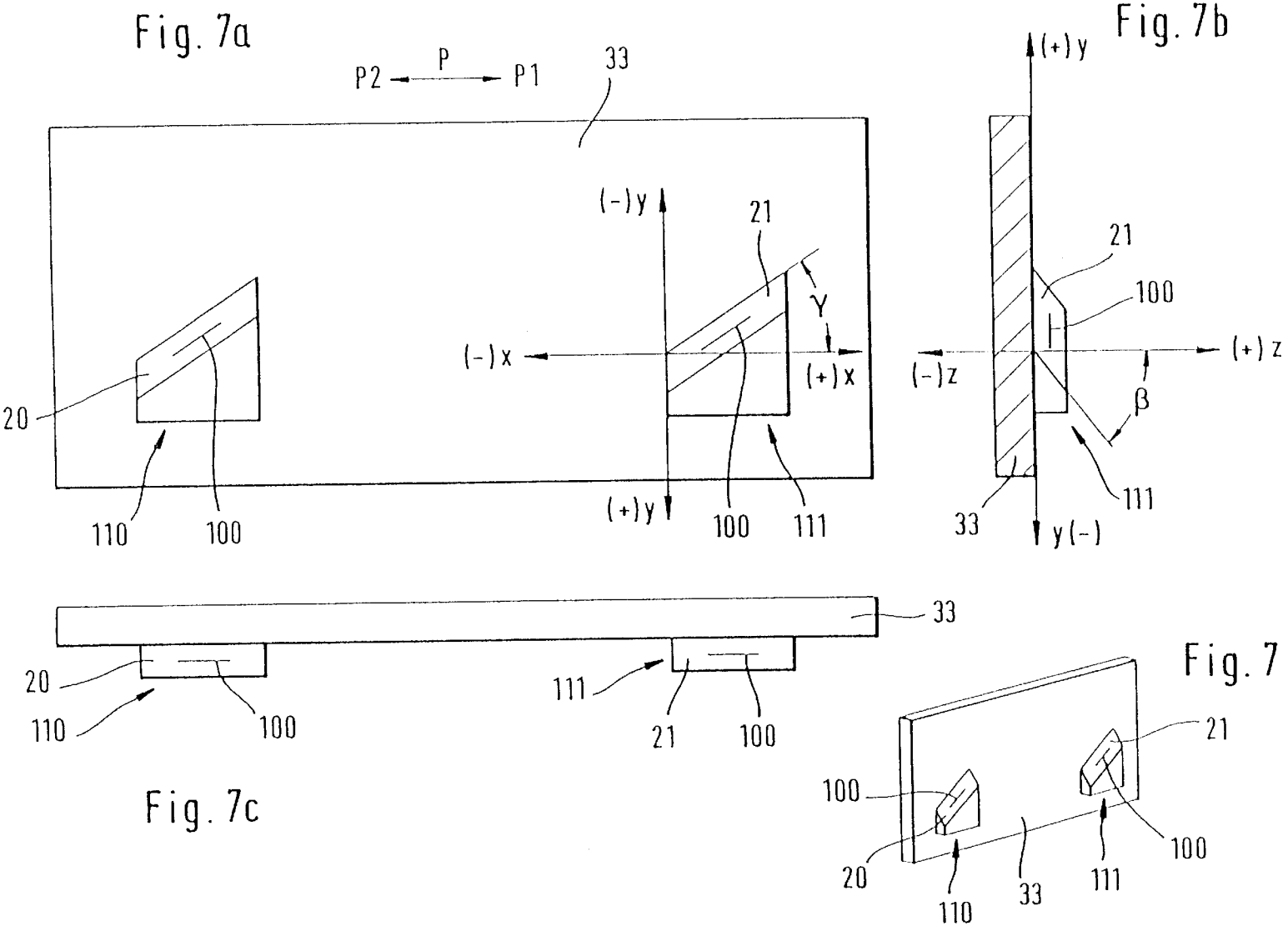
FIGS. 7, 7*a*, 7*b* and 7*c* are simplified schematic diagrams depicting the seating surfaces formed on a longitudinal side wall of the removable frame including the seating surfaces' contours.

The x-axis shown in FIG. 7*a* extends in the longitudinal direction of the bar 33 of the removable frame WR, that is, parallel to the direction of oscillation P of the undercutter 22—see FIG. 3. The y-axis intersects the x-axis at right angles. Proceeding from the origin of the coordinates, the seating surface 21 with the contact line 100 characteristic of the seating engagement with the detent element 19 extends at a predetermined angle γ, being inclined both relative to the x-axis and relative to the y-axis, whereby a position-force component FS—see FIG. 6—in the direction (+)x becomes effective.

FIG. 7*b* shows the y-axis and the z-axis intersecting the y-axis at right angles in order to show, proceeding from the origin of the coordinates, the sloping course of the seating surface 21. The z-axis represents the direction of action of the locking force FR. The seating surface 21 extends at a predetermined angle β, being inclined both relative to the z-axis and relative to the y-axis, whereby a holding-force component FU in the direction (–) y becomes effective.

FIG. 7*c* shows a side view of the bar 33 and of the projections 110 and 111 with the seating surfaces 20 and 21 and the contact lines 100 in a plan view.

FIG. 7 shows a perspective view of the schematically illustrated bar 33 of the removable frame WR with the projections 110, 111 formed thereon and the seating surfaces 20 and 21 provided on said projections.

Figure 7D:
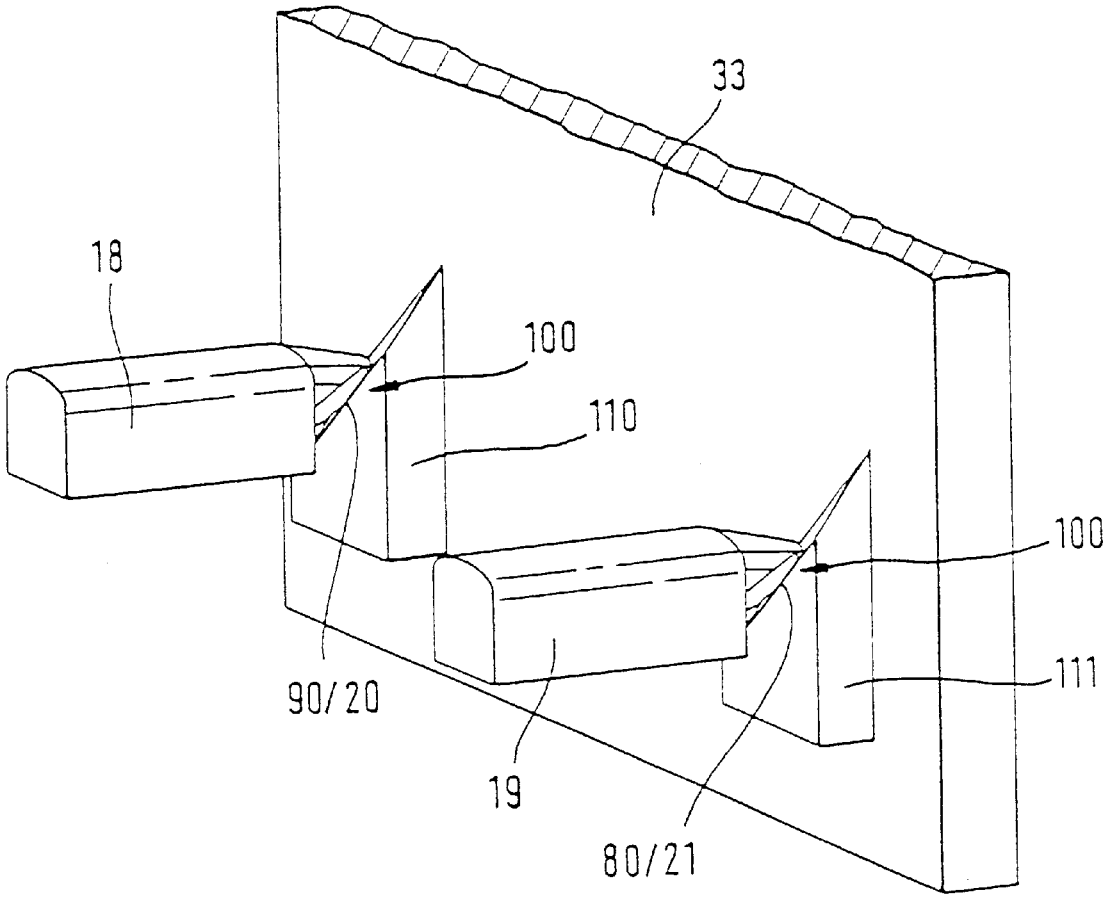
FIG. 7*d* is a schematic diagram depicting a longitudinal side wall of the removable frame having seating surfaces formed thereon and detent elements whose seating surfaces act upon the seating surfaces on the longitudinal side wall of the removable frame.

FIG. 7*d* shows a perspective view of the bar 33 with the projections 110, 111 of FIGS. 7 to 7*c* formed thereon as well as detent elements 18, 19 making engagement with the contact lines 100 by means of their seating surfaces 80, 90.

Figure 9:
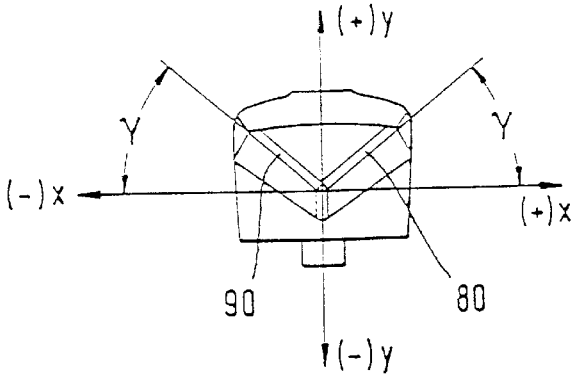
FIG. 9 is a view of the seating surfaces of a detent element extending towards each other in wedge shape.
Figure 8:
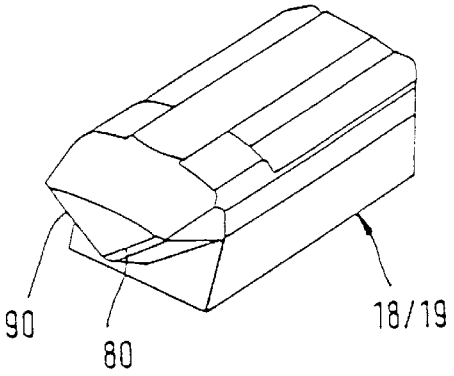
FIG. 8 is a perspective view of a detent element having seating surfaces extending towards each other in wedge shape.

The detent elements 18, 19 resiliently arranged in a housing central portion 15—see FIG. 3 and FIG. 5—may have one end thereof provided with a seating surface 80 or 90. To ensure that the removable frame WR can be installed either way, each of the detent elements 18, 19 is provided with a seating surface 80 and a seating surface 90, as shown in FIG. 8 and in FIG. 9. The seating surfaces 80 and 90 extend in wedge shape at a predetermined angle γ to the x-axis, as illustrated in FIG. 9 by the coordinates. The seating surfaces 80, 90 are of a very narrow construction so that on engagement with the seating surfaces 20 and 21 of the projections 110, 111 a line-type contact takes place between these seating surfaces 20, 21 and 80, 90 as identified by the contact lines 100 shown.

Figure 10:
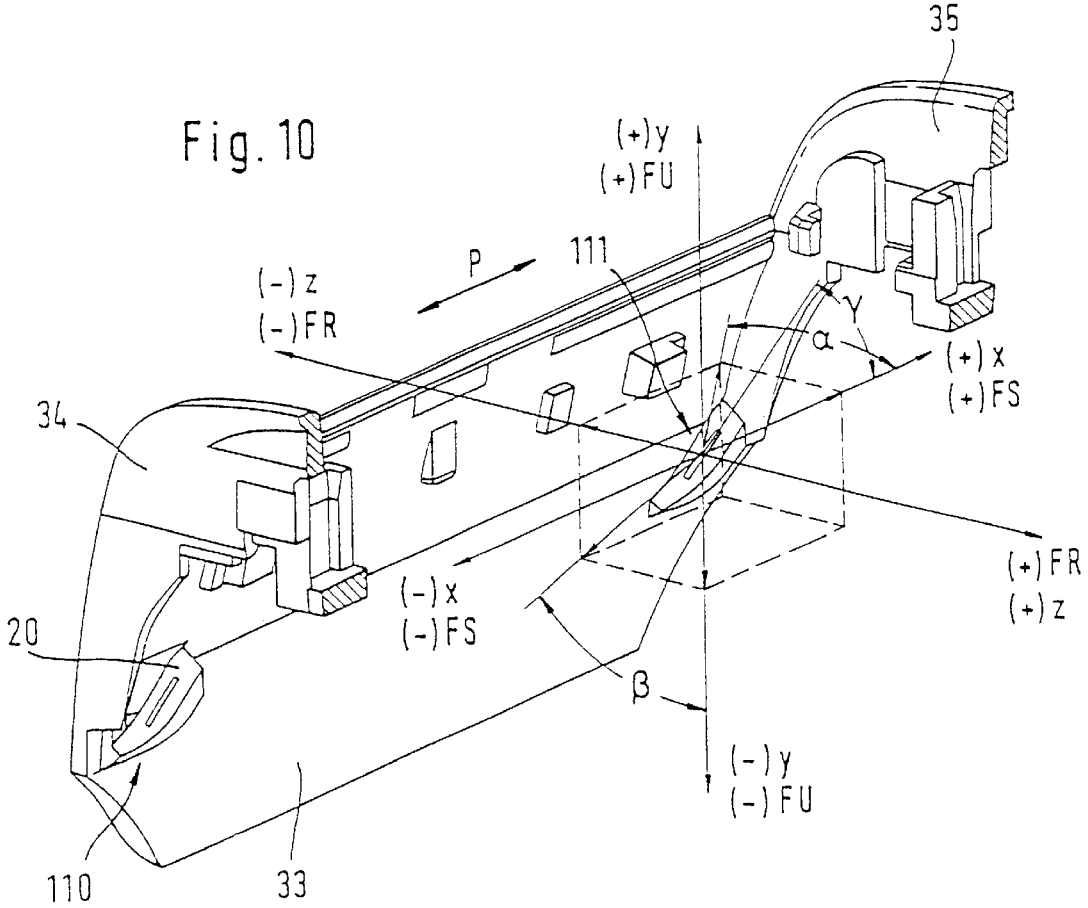
FIG. 10 is a perspective view of the inside of a bar of a removable frame, showing seating surfaces and half of the end walls.

FIG. 10 shows by way of example a perspective view of part of a removable frame WR, illustrating the bar 33 having formed thereon projections 110, 111 with seating surfaces 20, 21 and end walls 34, 35 formed at the ends of the bar 33, only half of said end walls being shown to reveal the shape of the seating surfaces 20, 21. In order to give a three-dimensional representation of the conversion of the locking force FR exerted by the detent elements 18, 19 into a holding-force component FU and a position-force component FS as shown with reference to FIGS. 5, 6 and 7 to 7*d*, FIG. 10 shows all space coordinates x-y and z and the angles: β and α which correspond to the spatial alignment of the seating surfaces 20, 21, 80, 90 in a system of coordinates relating, for example, to the seating surface 21, with the origin of the space coordinates being determined by a contact point selected in the middle of the contact line 100. As becomes apparent from this representation and from the representation of FIG. 4, all the seating surfaces 20 and 21 on the bars 32 and 33 need to be ascending at an angle y relative to the coordinate axes x and y in order to produce the position-force component FS provided in the direction (+) x, which moves the removable frame WR against the stop AG provided in the housing part G, holding it subsequently vibration-free against said stop AG.

We claim:

1. A replaceable frame for a powered shaving apparatus having a drive mechanism disposed in a shaver housing defining a frame-receiving region and carrying proximate said frame-receiving region a plurality of protruding, resiliently mounted detent elements, said replaceable frame comprising a frame housing having a top surface and defining a shaver housing-receiving mounting portion, said frame housing having at least one lateral wall extending between opposite first and second ends thereof, at least one cutter element carried on the frame housing, and a plurality of inclined camming surfaces formed on the lateral wall of the frame housing, each said inclined camming surface adapted to seat a respective said detent element of the shaver housing, wherein each said inclined camming surface extends between a first lateral position proximate said first end and spaced a first distance from said top surface and a second lateral position further from said first end and spaced a second distance from said top surface different from said first distance, whereby said camming surfaces direct a locking force exerted by the resiliently mounted detent elements on said frame housing when the replaceable frame is adapted to be mounted on the shaving apparatus to urge the frame onto and laterally against the shaver housing.

2. The replaceable frame as claimed in claim 1, wherein the camming surfaces are upwardly inclined in a direction extending generally from the mounting portion towards the top surface.

3. The replaceable frame as claimed in claim 1, wherein the inclined camming surfaces ascend towards the top surface, whereby the said second position is closer the top surface than is said first position.

4. The replaceable frame as claimed in claim 1, wherein the inclined camming surfaces project outwards from a surface of the lateral wall on which they are formed.

5. The replaceable frame as claimed in claim 1, wherein the frame housing has two said lateral walls, at least one of said plurality of inclined camming surfaces being formed on each said lateral wall.

6. The replaceable frame as claimed in claim 5, wherein the plurality of inclined camming surfaces comprises a pair of said inclined camming surfaces disposed on each said lateral wall.

7. The replaceable frame as claimed in claim 1, wherein the inclined camming surfaces are formed on an inwardly directed surface of the lateral wall for mating with oppositely directed detent elements formed on the shaver housing.

8. The replaceable frame as claimed in claim 1, wherein the inclined camming surfaces are configured as narrow ledges.

9. The replaceable frame as claimed in claim 1, wherein the frame housing is adapted to be received adjacent a stop surface formed on an upstanding wall of the shaver housing frame-receiving region, and at least one said end of the frame housing is adapted to be cammed into abutment with said stop surface.

10. The replaceable frame as claimed in claim 1, wherein said at least one cutter element reciprocates.

11. The replaceable frame as claimed in claim 1, wherein said at least one cutter element reciprocates linearly parallel a first motion axis.

12. The replaceable frame as claimed in claim 11, wherein the frame housing defines a longitudinal frame axis parallel the first motion axis.

13. The replaceable frame as claimed in claim 1, wherein the frame housing is elongate.

14. The replaceable frame as claimed in claim 1, wherein the frame housing defines a longitudinal frame axis.

15. The replaceable frame as claimed in claim 14, wherein the inclined camming surfaces are nonparallel said longitudinal frame axis.

16. The replaceable frame as claimed in claim 14, wherein said longitudinal frame axis is a substantially straight major axis.

17. The replaceable frame as claimed in claim 14, wherein said longitudinal frame axis lies in a vertical plane carrying mutually orthogonal reference x-axis and y-axis, said x-axis being parallel said longitudinal frame axis, and a z-axis extends from said vertical plane mutually orthogonal said x-axis and said y-axis, and wherein a projection of each said inclined camming surface onto said vertical plane is inclined relative said x-axis and said y-axis, said inclined camming surface also being inclined relative said z-axis.

18. The replaceable frame as claimed in claim 1, wherein said at least one cutter element is adapted to move relative a first motion axis.

* * * * *